US005356215A

United States Patent [19]

Inoue et al.

[11] Patent Number: 5,356,215

[45] Date of Patent: Oct. 18, 1994

[54] MIXING DEVICE

[75] Inventors: Takao Inoue; Yukihiro Omika, both of Tokyo, Japan

[73] Assignee: Kajima Corporation, Tokyo, Japan

[21] Appl. No.: 113,513

[22] Filed: Aug. 30, 1993

Related U.S. Application Data

[63] Continuation of Ser. No. 794,055, Nov. 19, 1991, abandoned.

[30] Foreign Application Priority Data

Nov. 21, 1990 [JP] Japan ..... 2-317005
Sep. 17, 1991 [JP] Japan ..... 3-236653

[51] Int. Cl.[5] ..... B01F 7/24

[52] U.S. Cl. ..... 366/293; 366/314; 366/319; 366/321

[58] Field of Search ..... 366/318, 322, 323, 314, 366/205, 325, 327, 329, 330, 319, 279, 292, 293, 295, 321, 324, 327, 328, 65

[56] References Cited

U.S. PATENT DOCUMENTS

| | | | |
|---|---|---|---|
| 332,349 | 12/1885 | Knox | 366/321 |
| 364,622 | 6/1887 | Zies | 366/321 |
| 384,719 | 6/1888 | Safely | 366/314 |
| 721,974 | 3/1903 | Smith | 366/328 |
| 1,323,361 | 12/1919 | Grabler et al. | 366/321 |
| 2,203,672 | 6/1940 | Chester | 366/329 |
| 2,871,000 | 1/1959 | Dowling | 366/289 |
| 3,374,989 | 3/1968 | Todtenhaupt . | |
| 4,627,735 | 12/1986 | Rose et al. | 366/321 |
| 4,802,771 | 2/1989 | Weetman | 366/330 |

FOREIGN PATENT DOCUMENTS

| | | | |
|---|---|---|---|
| 0305576 | 3/1989 | European Pat. Off. . | |
| 1069118 | 10/1954 | Fed. Rep. of Germany | 366/318 |
| 2736812 | 3/1979 | Fed. Rep. of Germany | 366/325 |
| 2121014 | 8/1972 | France . | |
| 2626787 | 8/1989 | France . | |
| 0315164 | 7/1929 | United Kingdom | 366/325 |
| 1187632 | 4/1970 | United Kingdom . | |

OTHER PUBLICATIONS

Patent Abstract of Japan, "Stirrer for Melted Glass", vol. 7, No. 185 (C-181)(1330) Aug., 1983, for JP-A-58 088 126.

*Primary Examiner*—David A. Scherbel
*Assistant Examiner*—Tony G. Soohoo
*Attorney, Agent, or Firm*—Wenderoth, Lind & Ponack

[57] ABSTRACT

Spiral-shaped screw blades disposed one on another on the bottom of a mixing container are rotated at a high speed for agitating pulverulent materials including aggregate and water to form a mixture. A rapid current of the mixture of the pulverulent materials and water is brought about by the rotating screw blades and causes the aggregate in the mixture to serve as a mixing agitator like milling balls used in a ball mill, to thereby effectively break up lumps of the pulverulent material which are immiscible with water and which are inevitably formed by initially mixing the pulverulent material with water.

10 Claims, 7 Drawing Sheets

MIXING DEVICE

This application is a continuation of now abandoned application, Ser. No. 07/794,055, filed Nov. 19, 1991, abandoned.

BACKGROUND OF THE INVENTION

1. Field of the Invention

This invention relates to a device and method for mixing mortar or the like, and more particularly to a mixing device capable of effectively stirring and mixing pulverulent materials such as cement with water by rotating screw blades while serving aggregate contained in the pulverulent materials as a mixing agitator like milling balls in a ball mill.

2. Description of the Prior Art

For example, in a case of making ready-mixed concrete, if raw materials such as cement and aggregate are mixed with water at one time, desirable cement paste cannot be obtained nor solidified intensely because the cement and aggregate will not be uniformly dispersed in the cement paste. The cement in the form of fine pulverulent particles tends to gather in the water to form lumps which are immiscible with the water. The finer the pulverulent particles are which are to be mixed with water having surface tension, the easier such immiscible lumps of the pulverulent particles occur. The surface tension of the water acts on air accommodated in the lumps of the particles, such that the lumps of the particles become difficult to break.

As typical mixers of this type, there have been so far practically used a forced stirring type pan mixer, a horizontally biaxial mixer, and a tilting mixer with a rotary drum. Each of these conventional mixer is provided with a mixing blade or rotary drum as a mixing agitator means which is rotated at a low speed to break the aforenoted lumps of pulverulent particles formed in a mixture paste.

However, since such conventional mixers generally adopt a stirring mechanism utilizing gravity, aggregate mixed in the mixture paste cannot bring about an agitating action as exerted by milling balls used in a ball mill (ball mill effect) because of large absorbed energy of water in the mixture paste. Thus, the conventional mixers are restricted in their ability to agitate the mixture paste. Accordingly, with the conventional mixers as noted above, theoretically, the aforementioned agitator means must be driven at a high speed of rotation for a long time in order to impart kinetic energy to the aggregate in the mixture. However, the mixture paste will be rotated while sticking to the rotating agitator means or scattered away without being stirred when the agitator means is rotated at a high speed. For that reason, in the conventional mixer, the mixture paste cannot be agitated at a high speed as a matter of course, so that the raw materials cannot be mixed sufficiently and dispersed uniformly in the mixture paste resultantly obtained.

As one attempt to effectively mix cement and aggregate with water, Japanese Patent Publication SHO 61-7928(B) has proposed a step mixing device in which cement is initially mixed with water to obtain cement paste as an intermediate, so that aggregate such as sand can be mixed with the cement paste thus obtained by using another mixer. However, with this conventional mixing device, lumps of cement which are immiscible with water are inevitably formed in the mixture and cannot be effectively broken and dispersed uniformly in the mixture, because air accommodated in the lumps of cement serves as a cushion when the agitator is rotated slowly or because of other possible reasons.

Various studies have been made by the inventors on how kinetic energy for effectively breaking the lumps of pulverulent materials such as cement can be introduced into a mixture paste to uniformly disperse the pulverulent materials in the mixture paste.

From the results of the studies made by the inventors, it was first confirmed that it is desirable to exert kinetic energy directly to fine aggregate such as sand in order to completely break the lumps of the pulverulent materials which are immiscible with water by an agitating action brought about by the aggregate like milling balls contained in a ball mill. The "mortar" herein is obtained by uniformly dispersing inert fine aggregate (sand and the like) and active binding materials (mixture of fine powdered particles such as cement clinker, silica, blast furnace slag, and fly ash, which react with water or chemical solution) in water and mixing agents. Therefore, by driving the agitator of a mixer at a high speed to impart kinetic energy to the lumps of the pulverulent materials and fine aggregate in the mixture, the aggregate can collide with the lumps of the pulverulent materials, resulting in introduction of the kinetic energy into the lumps of the pulverulent materials which are immiscible with water. Thus, the aggregate in the mixture stirred at high speed can be practically used instead of the milling balls used in the ball mill.

Secondly, the mixture paste cannot easily be prevented from being rotated with the rotary agitator means such as a mixing blade or drum driven at a high speed nor from being scattered away when using the mechanism of the conventional mixer in which only the drum or single mixing blade is rotated. The inventors have found a solution to easily and properly mix such pulverulent materials with water by driving two rotary agitating members at a high speed. The rotary agitating members are disposed one on another and rotated at high speed so as to cause the mixture paste of the pulverulent materials and water to move fast in between the opposed agitating members. In the region between the rotating agitating members, the mixture paste flows rapidly and is compressed. Under the high pressure brought about by the rapid current of the mixture paste between the agitating members, the aggregate functions as the milling balls used in the ball mill.

Thirdly, it was further found that the particles of the fine aggregate in the mixture paste discharged from between the opposed agitating members act on the lumps of the pulverulent material which remain static in a mixing container. This is because the particles of the fine aggregate paste rapidly flowing out from between the agitating members are caused to rush into the mixture paste moving around in the mixing container.

OBJECT OF THE INVENTION

This invention was made on the basis of the knowledge described above. Accordingly it is an object of the present invention to provide a mixing device and mixing method capable of effectively mixing various pulverulent materials including aggregate with a liquid to produce a suitable mixture in which the pulverulent material is uniformly dispersed, by causing the aggregate contained in the mixture to function as milling balls generally used in a ball mill, to thereby bring about collision of the aggregate with lumps of pulverulent particles which are immiscible with the liquid.

SUMMARY OF THE INVENTION

To accomplish the object described above according to the present invention there is provided a mixing device comprising a mixing container for mixing materials including aggregate, and spiral-shaped screw blades disposed one above another vertically opposite to each other near the bottom of the mixing container, which are rotated at high speed to cause the mixing materials to flow fast between the screw blades and serve to agitate and mix the aggregate contained in the mixing materials.

A mixing method according to this invention comprises placing pulverulent materials including aggregate with a liquid into the mixing container, and rotating the aforementioned screw blades at high speed so as to serve as a mixing agitator for the pulverulent materials and water.

The vertically opposed screw blades are rotated at a high speed such as a circumferential speed of about 2 to 70 meters per minute, preferably, about 8 to 55 meters per minute.

Strong kinetic energy of a propulsive current of the mixture mixed in the container is caused by rotating the screw blades at a high speed and is imparted to fine aggregate such as sand which is placed into the mixing container as one of the mixing materials, to consequently bring about a difference in inertia force between the fine aggregate and lumps of pulverulent particles possibly formed in the mixing materials. As a result, the lumps of the pulverulent materials are broken into fine particles, and then, the fine particles are uniformly dispersed in the mixture.

The fine aggregate flowing out from between the opposed screw blades further rush with a large inertia force into the mixture statically remains around the inner wall surface of the containers. Consequently, the lumps of the pulverulent particles in the mixture in the container are more completely broken and uniformly dispersed in the mixture.

By continuously driving the screw blades, the particles into which the lumps of the pulverulent materials are broken are moved along the inner wall surface of the container and circulated in the container by convection.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

Figure 1:
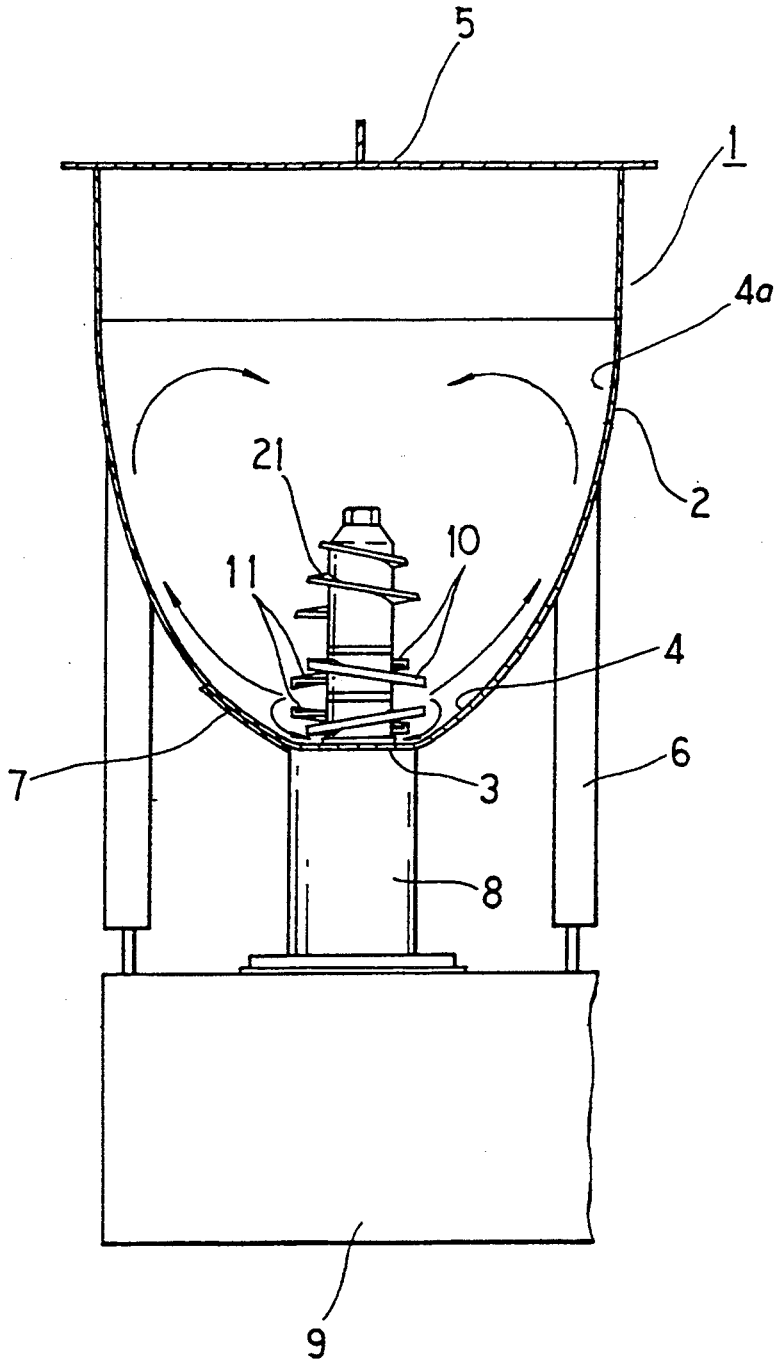
FIG. 1 is a schematic diagram showing a first embodiment of the mixing device according to this invention.
Figure 2:
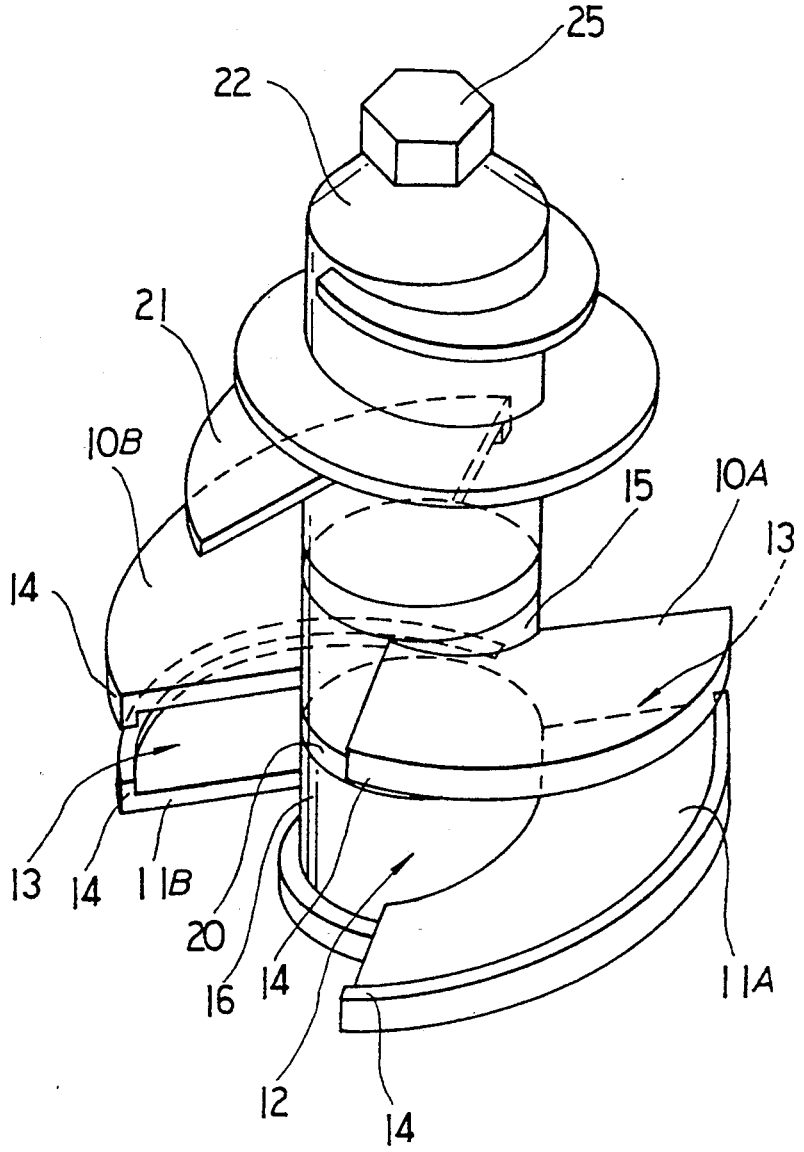
FIG. 2 is an explanatory diagram showing a principal portion of FIG. 1.

One embodiment of the mixing device according to this invention will be described hereinafter with reference to FIG. 1 through FIG. 6.

The mixing device 1 comprises a mixing container 2 for the materials to be mixed, the container 2 having a bottom 3, and screw blades 10 and 11 which are disposed one on another in vertically opposed and spaced apart relationship to each other at a distance from the bottom 3.

The mixing container 2 has an inner wall surface 4 shaped in an arc or parabola, in section, and having gradually decreasing inner diameter toward the bottom 3. That is to say, the inner wall surface 4 of the container 2 slants with slight curvature so as to permit the materials to be mixed in the container to flow from the horizontal direction to the upward direction along the slightly curved inner wall surface 4. The inner wall surface 4 is inclined at about 25° to about 70°, preferably about 30° to about 55°. The inner wall surface 4 leads to a sharply inclined circulating guide surface 4*a*.

In the drawings, reference numeral 5 denotes a lid for covering an inlet of the container, 6 denotes a supporting frame for the container, 7 an outlet of the container from which a mixture resultantly obtained is discharged, 8 denotes a rotary shaft portion for the screw blades 10 and 11, and 9 a basal casing accommodating an electric motor (not shown) and other elements for driving the screw blades at high speed.

The screw blades 10 and 11 are each fixed on a hub 15 or 16 so as to be inclined in a spiral manner around the corresponding hub. Each screw blade 10, 11 assumes a sector shape as viewed from above having a central angle of about 30° to about 270°. The central angle of the screw blade may be determined in accordance with the viscosity and specific gravity of the mixing materials to be dealt with. When the central angle is less than 30°, sufficient propulsive force will not be obtained. When the central angle is larger than 270°, it becomes difficult to introduce the mixing materials into between the screw blades. When dealing with mortar, it is preferable to utilize a central angle of the screw blade to about 60° to about 120°.

The screw blades 10 and 11 may be used in pairs so that each blade of the pair of blades is opposite to the other with a hub 15 or 16 therebetween. The paired screw blades 10, 11 are vertically superposed one on another and are rotated to cause collision of propulsive currents of the mixture in the space between the rotating blades. Each pair of vertically opposed blades has front edges separated widely relative to the direction of rotation to form a wide intake aperture 12 and rear edges separated narrowly to form a narrow discharge aperture 13. As a result, by rotating the screw blades 10, 11 in the mixture in the same direction, a high pressure current $\alpha$ of the mixture is discharged from the discharge aperture 13 formed between the screw blades.

When the blade is formed of a thin plate having substantially equal thickness overall, the upper screw blade 10 is spirally inclined downwardly from the front edge to the rear edge thereof relative to the direction of rotation; whereas, the lower screw blade 11 is spirally inclined upwardly. Namely, the upper and lower screw blades are inclined in substantially opposite directions. The angle at which the screw blades 10 and 11 are inclined may be at least about 3° at which the current of the mixture can be changed in direction. The screw blades may be inclined at about 40° or less so as not to intercept the flow of mixture between the screw blades. The inclination of the screw blades may preferably be range of about 5° to about 15° in the for use in mixing mortar.

Figure 5:
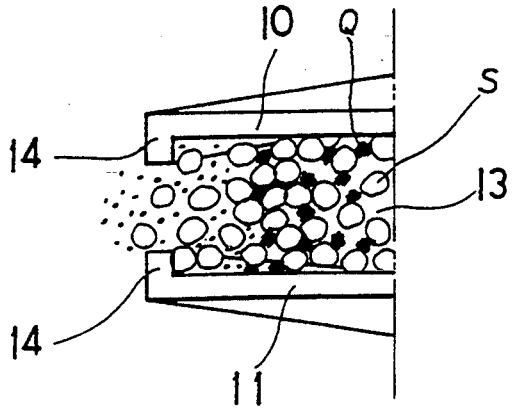
FIG. 5 is a schematic explanatory diagram showing in, part, the rotary blades as viewed from behind.

The screw blades 10, 11 may be inclined in the radial direction so that the space between the opposite screw blades narrows from their inner circumferential edges connected to the hubs 15, 16 toward the outer circumferential edges thereof so as to prevent the mixture flowing between the screw blades from escaping sideward. It is desirable to form opposite protrusions (or flanges) 14 on the outer circumferential edge portion as shown in FIG. 5 in order to heighten the effect of preventing the sideward escape of the mixture from between the screw blades.

To be more concrete, the screw blades 10, 11 each extend radially outwardly from the hub 15 or 16 fitted to a rotary shaft 17. In this case, each screw blade may be engaged with the rotary shaft 17 by means of a key groove 18 and a key 19. Between the hubs 15, 16 of the screw blades 10 and 11, there may be interposed a gap adjusting member 20 shaped as a ring having the same diameter as the hubs 15 and 16. A plurality of gap adjusting members which are different in height (h) may be prepared so that the distance between the screw blades 10 and 11 can be selectively changed in accordance with the specific gravity and viscosity of the mixture to be dealt with by this mixing device, the rotational speed of the screw blades and other possible factors. By adjusting the height (h) of the gap adjusting member 20, the mixture in the container can properly flow and be sufficiently mixed. Thus, the mixture parts around the screw blades 10 and 11 are effectively propelled by the rotating blades and collide with each other in the region behind the blades relative to the direction of rotation.

This mixing device may be provided with a circulating blade 21 for promoting circulation of the mixture in the container in consideration of the viscosity of the mixture to be dealt with. The circulating blade 21 may be of any design capable of introducing the mixture downward, e.g. a screw as illustrated in the drawings. The circulating blade 21 may be formed by extending a spiral fin from an axial member 22 having the same diameter as the hubs 15, 16. By rotating the circulating blade 21 with the screw blades 10 and 11, the mixture in the container can be effectively circulated and easily introduced into between the screw blades 10 and 11.

Figure 3:
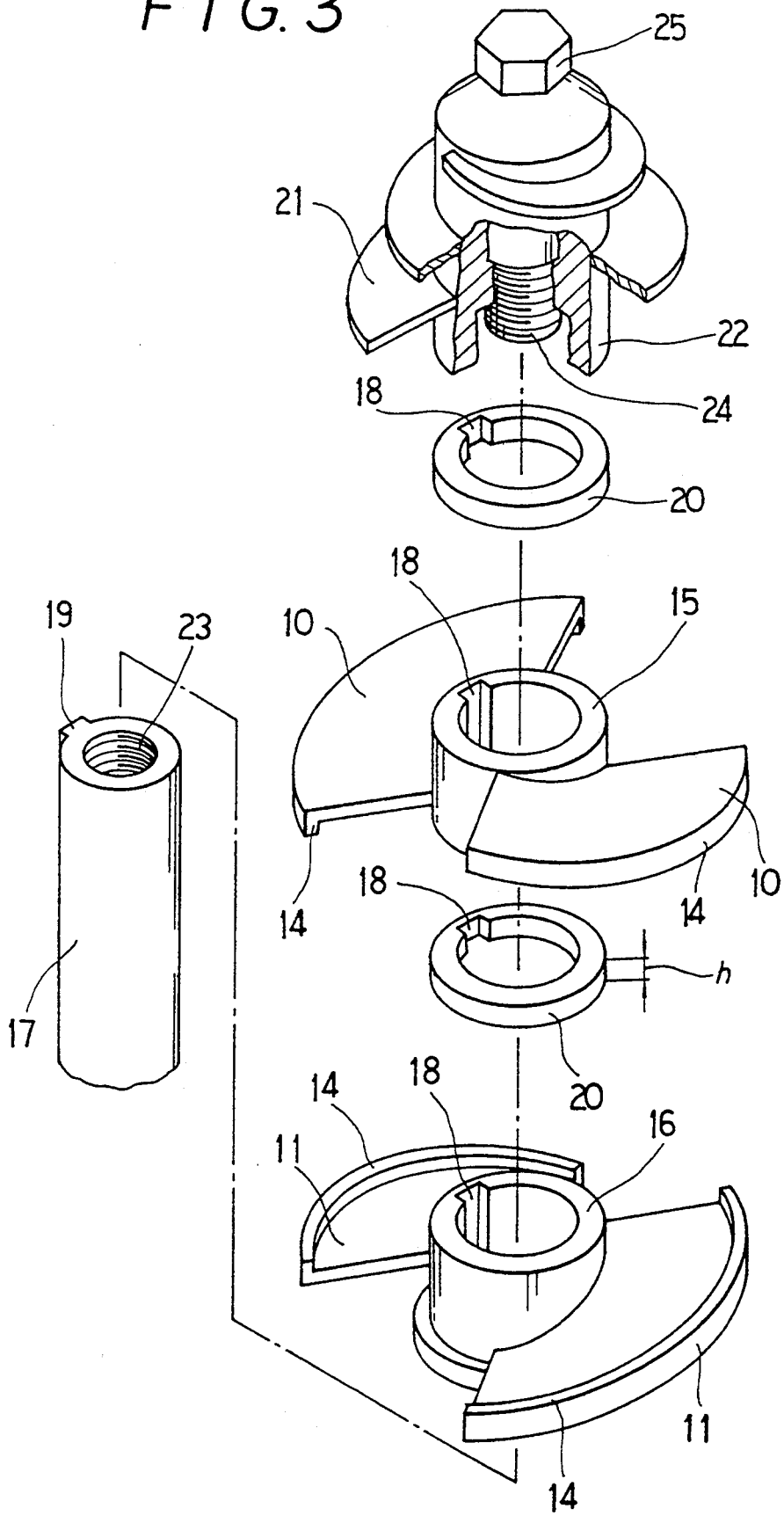
FIG. 3 is an exploded perspective view showing the principal portion of FIG. 1.

The combined screw blades 10, 11 and hubs 15, 16 are fixed onto the rotary shaft 17 by screwing as shown in FIG. 3. That is, the rotary shaft 17 is formed with a screw hole 23, and the axial member 22 having a screw 24 and a nut 25 is used. By tightening up the screw 24 in the screw hole 23, the screw blades and gap adjusting member can be fixed.

The screw blades may be rotated at such a rate that the outer edges of the rotating blades make a circumferential speed of about 2 meters per minute to about 70 meters per minute, preferably about 8 meters per minute to about 55 meters per minute. In this range of the circumferential speed, sufficient difference in inertial mass between the pulverulent particles contained in the mixture can be acquired.

Next, a method of mixing cement with water, for example, by use of the mixing device of this invention described above will be explained hereinafter.

Upon pouring a liquid such as water into the mixing container 2, the screw blades 10, 11 are rotated at high speed so as to bring about a strong current of water. Due to the rotation of the screw blades 10, 11, upward and downward propulsive currents of water occur between the blades 10A and 11A and between the blades 10B and 11B. The currents of water occurring around the blades 10A and 10B are directed downward at an angle according to the inclination of the screw blades 10A and 10B, and those around the blades 11A and 11B are directed upward at an angle according to the inclination of the screw blades 11A and 11B. Since the intake apertures 12 between the front edges of the blades 10 and 11 are wider than the discharge aperture 13 between the rear-edges of the same, the water flowing between the blades is discharged therefrom with increasing speed.

Next, pulverulent materials such as AE agents and cement are added to the water in the mixing container 2. At this time, as a matter of course, the pulverulent materials tend to gather in the water to form lumps of pulverulent particles (Q) which become immiscible with water.

Thereafter, fine aggregate (S) such as sand is added. With the rotation of the screw blades, difference a in inertia between the lumps of pulverulent particles (Q) and the fine aggregate particles is brought about. Although the aggregate particle is as small as about 0.1 mm to about 2 mm in diameter, it is caused to collide with the lumps of pulverulent particles by the rotating screw blades 10, 11, to thereby break the lumps of pulverulent particles (Q). Such collision of the aggregate particles with the lumps of pulverulent particles occurs not only in the region between the blades but also at the regions around and behind the screw blades relative to the direction of rotation, involving the so-called ball mill effect brought about by the aggregate particles agitated by the rotating screw blades with heavy pressure. The high pressure produced between the rotating screw blades can be determined to a desired value by adjusting the height (h) of the gap adjusting member 20.

Figure 4:
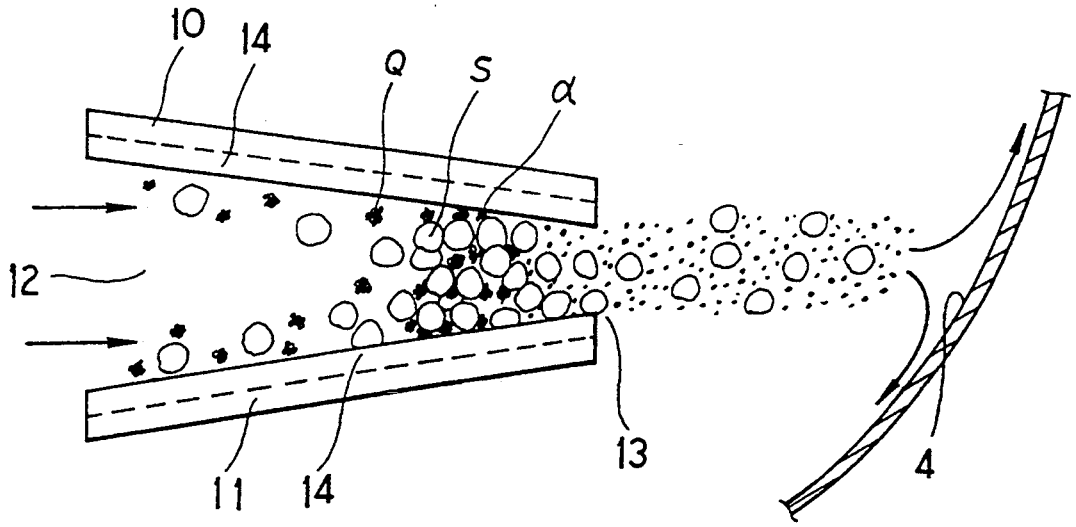
FIG. 4 is a schematic perspective showing a principal portion to explain the mixing principle of this invention.

Since the spaces between the screw blades are narrower toward the discharge apertures 13, the currents of mixture flowing between the blades becomes gradually faster as it advances toward the discharge apertures 13. The ball mill effect brought about by the aggregate particles contained in the mixture is simultaneously enhanced to strongly break and disperse the lumps of pulverulent particles in the mixture, as illustrated in FIG. 4.

Figure 6:
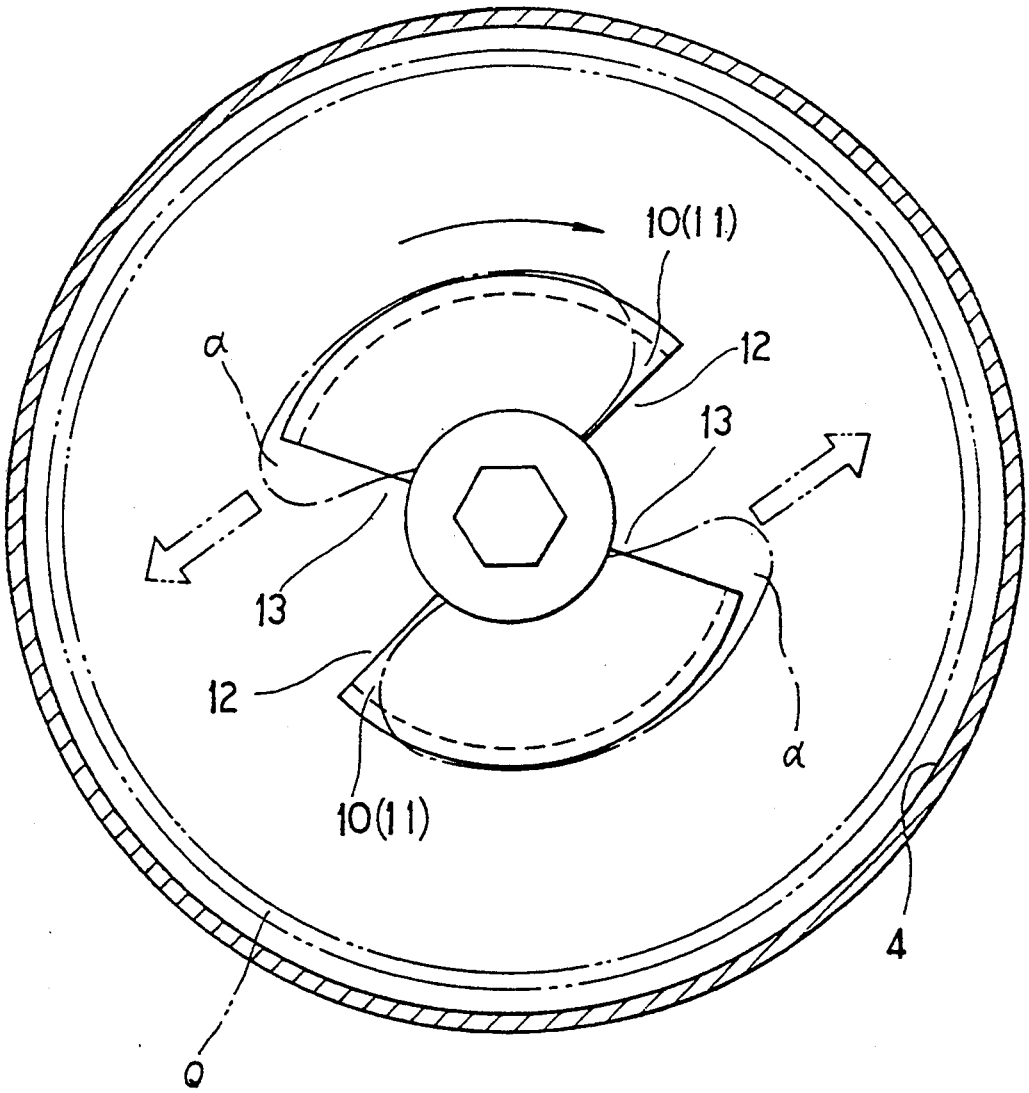
FIG. 6 is a plan view of FIG. 1.

The pulverulent particles thus dispersed in the mixture in the spaces between the screw blades are discharged with increasing speed from the discharge apertures 13 as if it was passing through an orifice, and then, move straight horizontally rearwardly as indicated by the imaginary arrows in FIG. 6. As a result, the fine aggregate particles having high inertia rush into the lumps of pulverulent particles (Q) which are static at the region around the inner wall surface 4 of the mixing container 2, such region being indicated by two-dot chain lines in FIG. 6. Thus, the lumps of pulverulent particles in the mixture are effectively broken by the aggregate particles serving as an agitator like milling balls in a ball mill and dispersed uniformly in the mixture.

The pulverulent particles thus dispersed move away from the discharge apertures 13 with the mixture and advance upwardly and downwardly along the inner wall surface 4 of the container without sticking to the wall surface of the container. Then, the mixture is circulated by convection caused by rotating the screw blades in the mixing container. Since the container 2 has a substantially parabolic configuration, the mixture which is discharged horizontally rearwardly from the discharge apertures 13 mostly advances upwardly along the inner wall surface 4 of the container. The mixture moved upwardly is again introduced into between the screw blades by the rotating blades. This circulation of the mixture is repeated.

Figure 7:
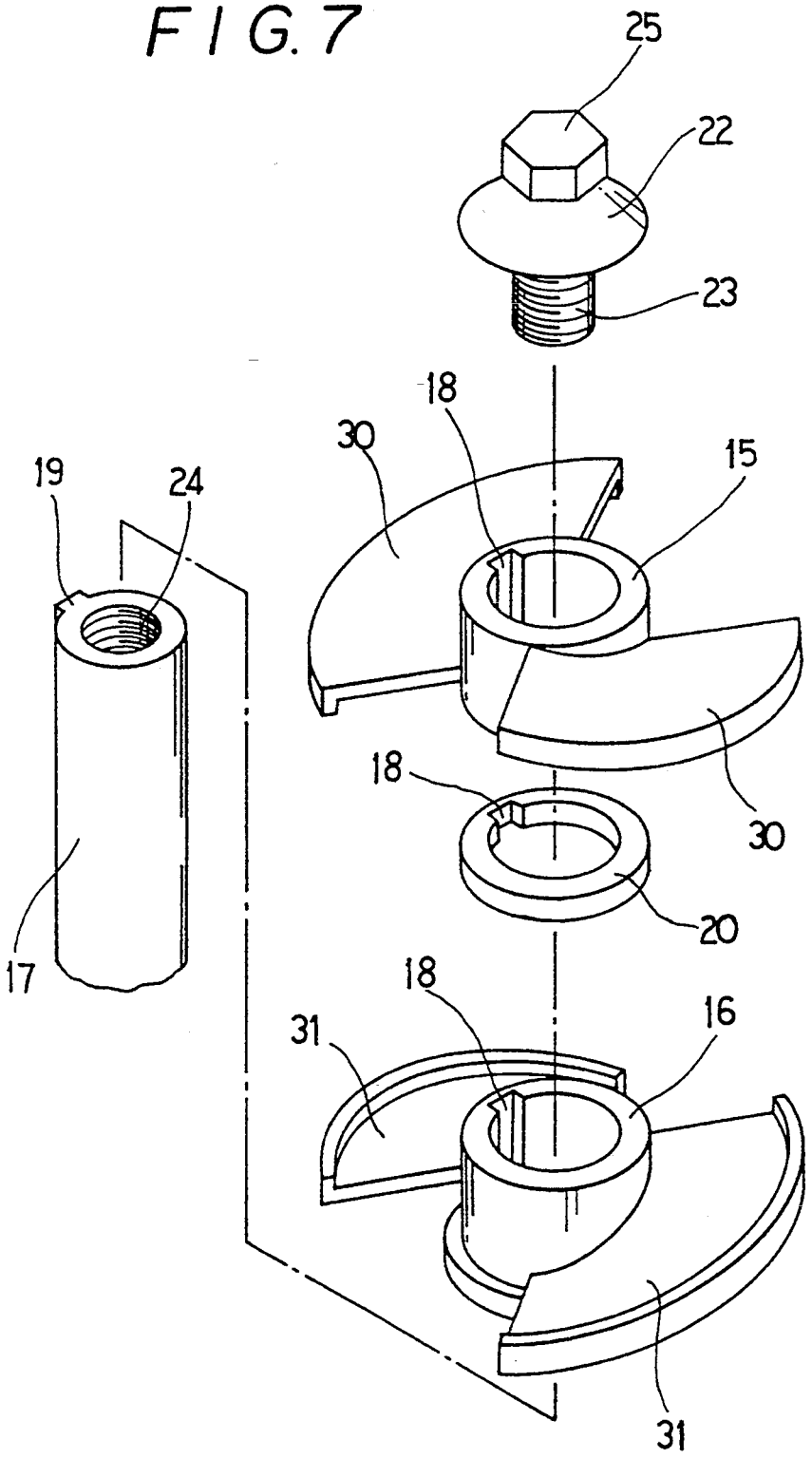
FIG. 7 is an exploded perspective view showing the principal portion of another embodiment.
Figure 8:
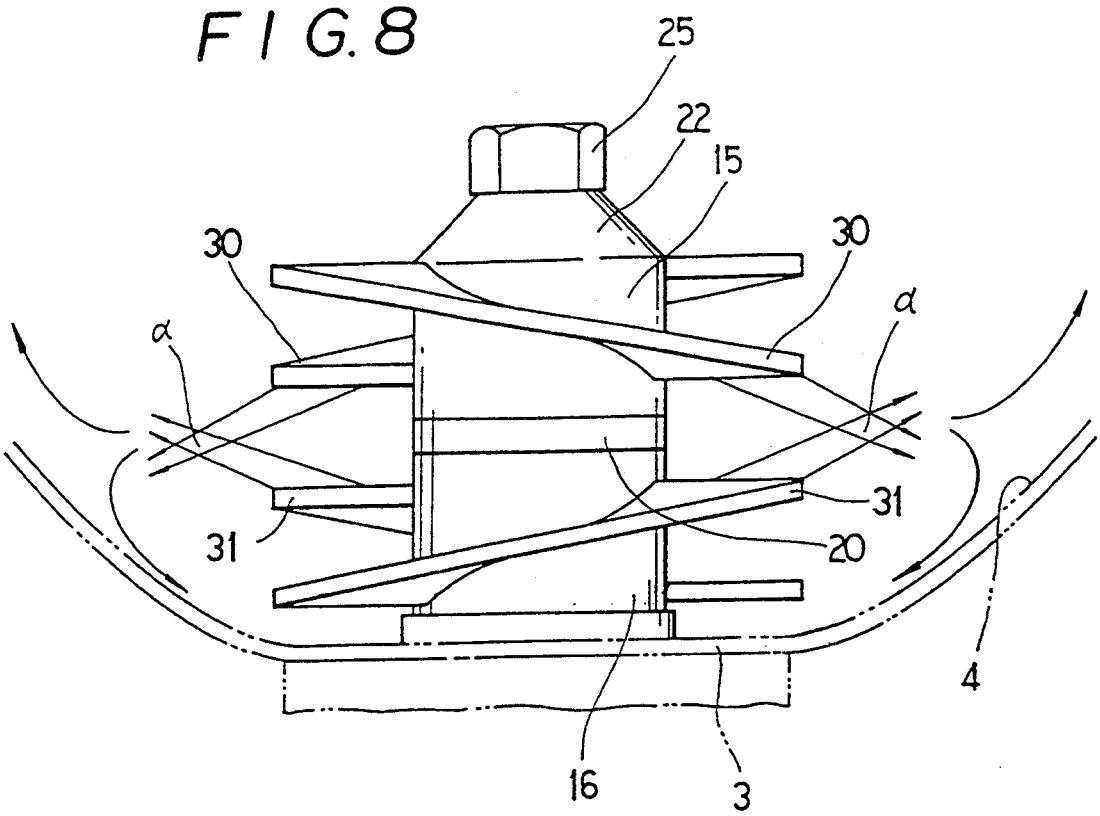
FIG. 8 is a front view showing the principal portion of the embodiment of FIG. 7.

Another embodiment of the mixing device of this invention is shown in FIG. 7 and FIG. 8. This mixing device is provided with screw blades 30 and 31 which define a space therebetween having a height equal in section in the horizontal direction, but has no circulating blade. Also in this embodiment, high speed collision of the mixture occurs around the rear edge portions of the screw blades to make a current of the mixture of high pressure, and lumps of pulverulent particles which are inevitably formed by initially mixing the pulverulent particles with water are effectively broken and uniformly dispersed in the form of fine particles in the mixture by the ball mill effect of the aggregate particles contained in the mixture which are agitated by the rotating screw blades 30, 31 at high speed. The mixing device of this embodiment is adapted particularly for mixing pulverulent materials having low viscosity.

Figure 9:
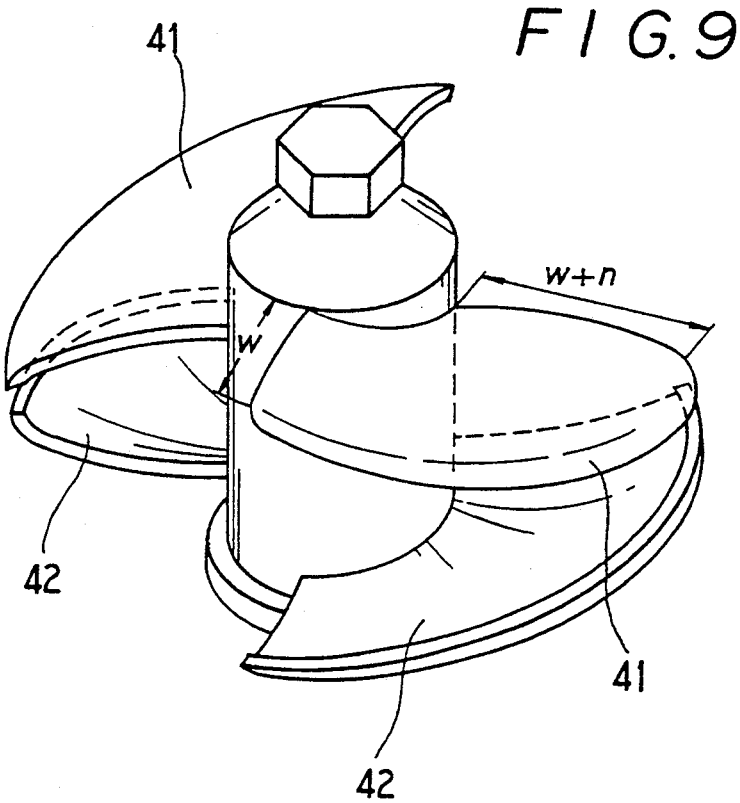
FIG. 9 is a perspective view showing the principal portion of still another embodiment of this invention.

FIG. 9 shows still another invention of this embodiment. The mixing device of this embodiment has screw blades 41 and 42 which are curved in the radial direction in such a manner that their outer circumferential edges are close to each other. The front edge of each screw blade has a width (w) smaller than a width (w+n) of the rear edge thereof. With this embodiment, the pulverulent particles can be more uniformly dispersed in the mixture by rotating the screw blades.

Though the foregoing explanation of the mixing device refers particularly to its use with cement paste, the present invention can be adapted for mixing various pulverulent materials regardless of the size of the particle and the viscosity of the mixture by determining the appropriate rotational speed and shape of the blades and the shape of the container in compliance with numerous uses. The mixing device of the present invention can be applied practically in its modified form to various fields including foods, medicines, metals, ceramics, plastics, livestock feed and so on.

As explained in the foregoing, according to the mixing device and method of the present invention, various pulverulent materials can be effectively mixed with a liquid such as water and uniformly dispersed in a resultantly obtained mixture by using the ball mill effect brought about by aggregate particles contained in the mixture to cause collision of the aggregate particles with lumps of the pulverulent material which are immiscible with water and are inevitably formed in the mixture. Therefore, the mixture of high quality in which the pulverulent materials are uniformly dispersed can be obtained.

Although the invention has been described in its preferred form with a certain degree of particularity, it is understood that the present disclosure of the preferred form can be changed in the details of construction and various combinations and arrangements of parts may be resorted to without departing from the spirit and the scope of the invention as hereinafter claimed.

What is claimed is:

1. A mixing device comprising:

a mixing container for containing mixing materials including aggregate to be mixed, said mixing container including an interior bottom surface and an inner wall surface shaped as an arc or parabola in vertical section such that said inner wall surface has a diameter which decreases gradually toward said interior bottom surface;

a rotary shaft extending upwardly from said interior bottom surface and being adapted for high speed rotation in a rotational direction;

an upper blade unit mounted to said rotary shaft for rotation therewith, said upper blade unit including a pair of spiral-shaped upper screw blades, each of said upper screw blades being inclined downwardly from its leading edge to its trailing edge with respect to the rotational direction; and a lower blade unit mounted to said rotary shaft for rotation therewith, said lower blade unit being disposed below said upper blade unit and including a pair of spiral-shaped lower screw blades aligned beneath said upper screw blades, respectively, each of said lower screw blades being inclined upwardly from its leading edge to its trailing edge with respect to the rotational direction, such that spaces are defined between said upper screw blades and said lower screw blades, respectively, which gradually decrease in vertical dimension from the leading edges to the trailing edges of said upper and lower screw blades, respectively;

wherein the materials contained in said mixing container are caused to be guided into said spaces between said upper and lower blades, respectively, to be collided with one another toward the trailing edges of said upper and lower screw blades, respectively.

2. A mixing device as recited in claim 1, wherein said rotary shaft is disposed at a substantially central location of said interior bottom surface of said mixing container, such that said inner wall surface of said mixing container slopes upwardly in a radiating manner away from a bottom end of said rotary shaft.

3. A mixing device as recited in claim 1, wherein each of said upper and lower screw blades has a sector shape with a central angle of about 30° to about 270° when viewed from above.

4. A mixing device as recited in claim 1, wherein each of said upper and lower screw blades has a sector shape with a central angle of about 60° to about 120° when viewed from above.

5. A mixing device as recited in claim 1, further comprising a ring-shaped gap adjusting member interposed between said upper blade unit and said lower blade unit.

6. A mixing device as recited in claim 1, further comprising a circulating blade mounted to said rotary shaft for rotation therewith, said circulating blade being superposed above said upper screw blades for promoting circulation of the mixture contained in said mixing container.

7. A mixing device as recited in claim 6, wherein said circulating blade comprises a spiral screw and defines a means for feeding the material downwardly toward said upper and lower screw blades when said rotary shaft is rotated.

8. A mixing device as recited in claim 1, wherein said upper screw blades are substantially diametrically opposed to one another relative to said rotary shaft; and said lower screw blades are substantially diametrically opposed to one another relative to said rotary shaft.

9. A mixing device as recited in claim 1, wherein each of said upper screw blades includes a downwardly protruding flange at its outer circumferential edge; and each of said lower screw blades includes an upwardly protruding flange at its outer circumferential edge.

10. A mixing device as recited in claim 1, wherein each of said upper screw blades is curved downwardly when viewed in radial section; and each of said lower screw blades is curved upwardly when view in radial section.

* * * * *